US008727038B2

(12) United States Patent
Chan

(10) Patent No.: US 8,727,038 B2
(45) Date of Patent: May 20, 2014

(54) CONTROL SYSTEM FOR DRILLING OPERATIONS

(76) Inventor: Yun Tak Chan, Houston, TX (US)

( * ) Notice: Subject to any disclaimer, the term of this patent is extended or adjusted under 35 U.S.C. 154(b) by 622 days.

(21) Appl. No.: 13/009,498

(22) Filed: Jan. 19, 2011

(65) Prior Publication Data

US 2011/0174538 A1 Jul. 21, 2011

Related U.S. Application Data

(60) Provisional application No. 61/296,402, filed on Jan. 19, 2010.

(51) Int. Cl.
*E21B 44/02* (2006.01)

(52) U.S. Cl.
USPC ..... 175/27; 175/40; 175/57; 166/75.11

(58) Field of Classification Search
USPC ..... 175/24, 27, 40, 205, 57; 166/75.11, 166/77.1
See application file for complete search history.

(56) References Cited

U.S. PATENT DOCUMENTS

| | | | | |
|---|---|---|---|---|
| 2,100,131 | A * | 11/1937 | Capeliushnicoff et al. | 303/6.01 |
| 3,031,169 | A | 4/1962 | Kimmell | |
| 3,373,823 | A * | 3/1968 | Benner et al. | 173/6 |
| 3,759,489 | A * | 9/1973 | Jones | 254/273 |
| 3,971,545 | A | 7/1976 | Warman | |
| 4,046,355 | A | 9/1977 | Martin | |
| 4,128,888 | A * | 12/1978 | Sheldon et al. | 702/9 |
| 4,139,891 | A * | 2/1979 | Sheldon et al. | 702/9 |
| 4,284,253 | A | 8/1981 | Uribe | |
| 4,403,655 | A | 9/1983 | Trout | |
| 4,434,971 | A | 3/1984 | Cordrey | |
| 4,519,585 | A | 5/1985 | Furrow | |
| 4,616,321 | A * | 10/1986 | Chan | 702/9 |
| 4,662,608 | A | 5/1987 | Ball | |
| 4,696,377 | A | 9/1987 | Richardson | |
| 4,865,393 | A | 9/1989 | Falcon | |
| 4,875,530 | A | 10/1989 | Frink | |
| 5,342,020 | A | 8/1994 | Stone | |
| 5,474,142 | A | 12/1995 | Bowden | |
| 5,671,912 | A * | 9/1997 | Langford et al. | 254/267 |
| 6,029,951 | A | 2/2000 | Guggari | |
| 6,918,454 | B2 | 7/2005 | Prior | |
| 6,994,172 | B2 | 2/2006 | Ray | |
| 7,044,239 | B2 | 5/2006 | Pinckard | |
| 7,059,427 | B2 | 6/2006 | Power | |
| 7,537,066 | B1 | 5/2009 | Flud | |
| 7,823,655 | B2 | 11/2010 | Boone | |
| 2004/0226748 | A1 | 11/2004 | Prior | |
| 2010/0147588 | A1 | 6/2010 | Terry | |

FOREIGN PATENT DOCUMENTS

| | | |
|---|---|---|
| EP | 0694114 | 1/2006 |

* cited by examiner

*Primary Examiner* — Blake Michener
(74) *Attorney, Agent, or Firm* — John K. Buche; Scott Compton; Buche & Associates, P.C.

(57) ABSTRACT

The present application is directed to a system providing automatic and manual control of a brake lever on band brake drawworks of a wellbore drilling rig. The system comprises a pneumatic cylinder attached to the brake lever; and a control means in fluid communication with the pneumatic cylinder, the control means being operationally configured to run the pneumatic cylinder in response to information obtained by the control means concerning one or more drilling parameters and operationally configured to disable the pneumatic cylinder.

10 Claims, 8 Drawing Sheets

CONTROL SYSTEM FOR DRILLING OPERATIONS

CROSS-REFERENCE TO RELATED APPLICATIONS

This application claims the benefit of previously filed U.S. provisional patent application No. 61/296,402, filed on Jan. 19, 2010.

STATEMENT REGARDING FEDERALLY SPONSORED RESEARCH OR DEVELOPMENT

Not applicable.

FIELD OF THE APPLICATION

The application relates generally to a system for controlling drilling operations that use band brake drawworks.

BACKGROUND

In drilling operations, a surface winch commonly referred to as drawworks is used to hoist a drill string via a cable whereby the drawworks is effective to payout and reel in the cable in order to raise and lower the drill string as desired. The drawworks includes a brake that controls the drill string payout to adjust the pressure applied to the drill bit suspended from the drill string against the earth formation at the bottom of a wellbore. As drilling progresses the pressure or "weight-on-bit" decreases. By releasing the drawworks brake, the weight-on-bit may be applied to the drill bit against the earth formation to promote further drill of the bore hole. Accordingly, the drawworks brake controls the payout of the drill string for affecting drilling parameters such as weight-on-bit and rate of penetration in a wellbore.

On many drilling rigs, the drawworks are equipped with band brakes surrounding the drawworks drum that are mechanically controlled by a driller/operator via a brake lever. Automated systems for controlling the brake lever have also been developed. For example, tension spring/wire line arrangements have been used to manipulate a drawworks brake lever back and forth between a brake position of the band brake and a release position of the band brake. However, tension spring/wire line arrangements must be detached from the brake lever and then re-attached between drilling intervals when making a connection of drill pipe resulting in lost production time. A hydraulic servo control has been developed to manipulate a drawworks brake lever. However, the cost for providing a hydraulic power unit, modifications to the existing drilling rig equipment and the limited intelligence of a hydraulic-mechanical system has resulted in limited application.

It is desirable to provide a means for controlling band brake drawworks unlike the above describe techniques.

SUMMARY

The present application is directed to a system providing automatic and manual control of a brake lever on band brake drawworks of a wellbore drilling rig. The system comprises a pneumatic cylinder attached to the brake lever; and a control means in fluid communication with the pneumatic cylinder, the control means being operationally configured to run the pneumatic cylinder in response to information obtained by the control means concerning one or more drilling parameters and operationally configured to disable the pneumatic cylinder.

The present application is also directed to a system for controlling band brake drawworks on a wellbore drilling rig. The system comprises a pneumatic double acting cylinder attached to a brake lever of the band brake drawworks; an air regulation means in fluid communication with an air supply and the pneumatic double acting cylinder; and an electronic control means in communication with the air regulation means, the electronic control means being operationally configured to (1) measure drilling information concerning one or more drilling parameters and (2) send control outputs to the air regulation means to dictate pressurized air flow to and from the pneumatic double acting cylinder.

The present application is also directed to a method for automatically controlling a brake lever on band brake drawworks of a wellbore drilling rig to provide constant weight-on-bit and rate of penetration drilling. The method comprising: (a) installing to a wellbore drilling rig (1) a pneumatic cylinder pivotally attached to a support surface at a first end and pivotally attached to the brake lever at a second end; and (2) a control means in fluid communication with the pneumatic cylinder, the control means being operationally configured to direct the flow of pressurized air to and from the pneumatic cylinder according to measured drilling information concerning one or more drilling parameters as measured by the control means; (b) operating the control means to position the pneumatic cylinder and brake lever in a brake position to apply the band brake prior to drilling; (c) measuring one or more drilling parameters via the control means during drilling; (d) adjusting the pneumatic cylinder and brake lever from the brake position to a brake release position according to one or more measured drilling parameters; and (e) adjusting the pneumatic cylinder and brake lever from the brake release position to the brake position once desired drilling parameters are achieved.

BRIEF DESCRIPTION

Figure 1:
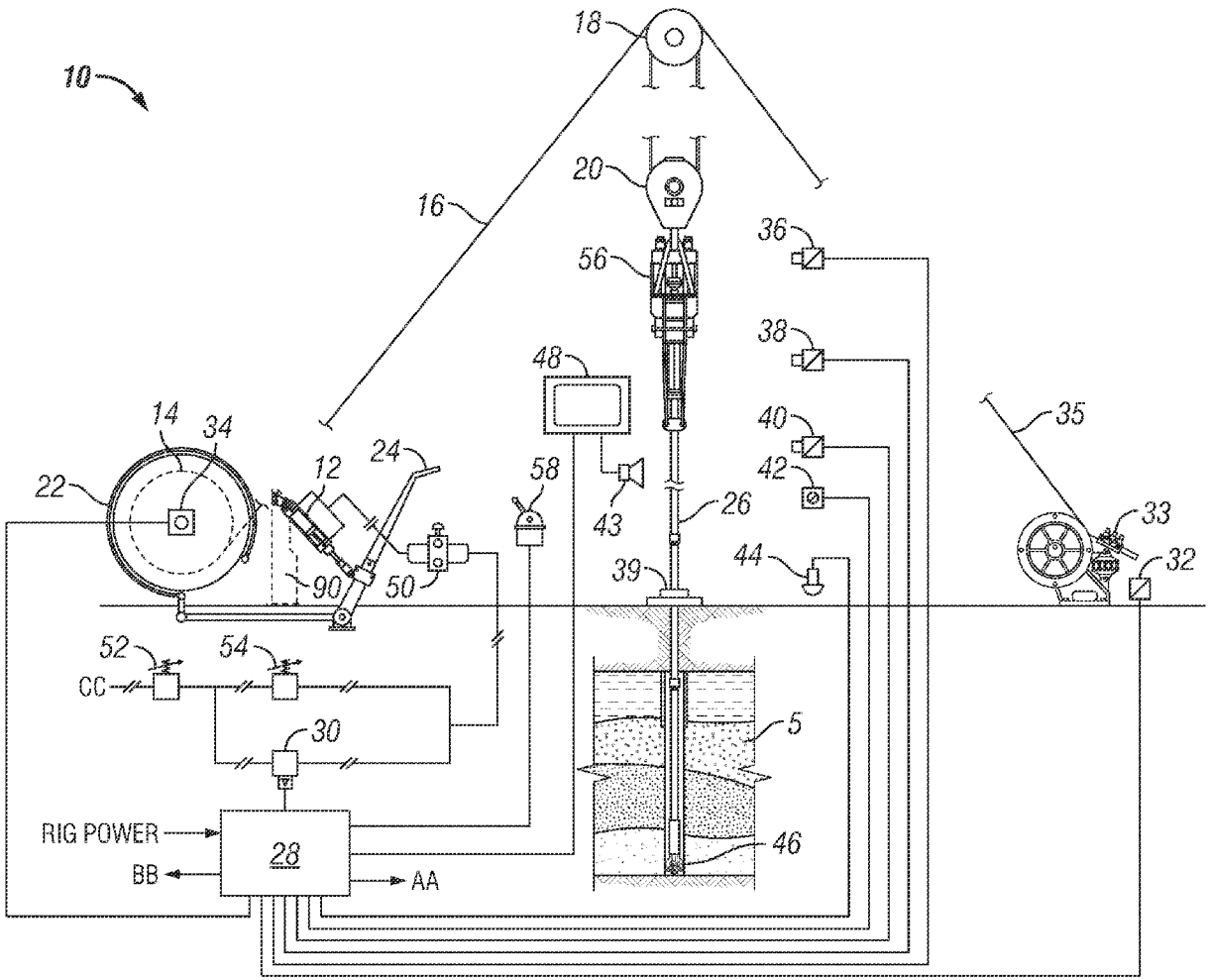
FIG. 1 illustrates a simplified embodiment of the present system as used with a wellbore drilling rig using band brake drawworks.

As understood by persons in the art of drilling, a typical wellbore drilling rig includes for example, (1) a power system including prime movers for powering drilling operations, (2) a rotating system including a kelly or power swivel, drill pipe, collars, and drill bits, (3) a hoisting system including a derrick, drawworks assembly, and drill line, (4) a circulation system, (5) well-control equipment, and (6) auxiliary equipment such as electronic data measurement sensors and display instrumentation. The present application provides a novel means for automatically controlling a hoisting system by manipulating the drawworks brake in response to on one or more drilling parameters measured during drilling operations. The application also provides a pneumatic means for controlling the hoisting system of a drilling rig based on electronic data collected during drilling operations. The present application also provides an integrated system for implementation with automated drilling rigs using band brake drawworks. The present system includes a pneumatic brake actuating means attached to a drawworks brake lever and electronic control means for dictating pressurized air flow to and from the pneumatic brake actuating means for manipulating the brake lever to provide desired weight-on-bit and rate-of-penetration drilling based on electronic data collected during drilling operations. Heretofore, such a desirable achievement has not been considered possible, and accordingly, the system and method of this application measure up to the dignity of patentability and therefore represents a patentable concept.

Before describing the invention in detail, it is to be understood that the present system and method are not limited to particular embodiments. It is also to be understood that the terminology used herein is for the purpose of describing particular embodiments only, and is not intended to be limiting. As used in this specification and the appended claims, "ROP" refers to rate of penetration as understood by persons of ordinary skill in the art of drilling. "RPM" means revolutions per minute. "WOB" means weight-on-bit, which refers to the amount of downward force exerted on a drill bit of a drill string at the bottom of a wellbore. The phrase "making a connection" refers to attaching a joint of drill pipe onto a drill string suspended in the wellbore to permit deepening the wellbore by the length of the joint added. For the purposes of this application, the term "brake lever" interchangeable with the term "brake handle." Likewise, the terms "drilling motor" and "mud motor are interchangeable.

In one aspect, the application provides for automatic wellbore drilling using band brake drawworks including using a pneumatic means for controlling the band brake.

In another aspect, the application provides a system for controlling a brake lever of band brake drawworks during automated wellbore drilling operations by employing a pneumatic means for controlling the band brake.

In another aspect, the application provides a system for controlling a brake lever of band brake drawworks during automated wellbore drilling operations by employing pneumatic double acting cylinder attached to the brake lever. The pneumatic double acting cylinder may be powered by rig air as typically found on wellbore drilling rigs as an economical means for supplying air for the pneumatic controls and clutches of the drilling rig. In the alternative, the pneumatic double acting cylinder may be powered by a separate air compressor reserved for use with the present system.

In another aspect, the application provides a pneumatic actuating means that may be permanently attached to a brake lever of band brake drawworks without delaying drilling operations when making a connection and/or making a trip.

In another aspect, the application provides a system for controlling a brake lever of band brake drawworks including installing a pneumatic actuating means to an existing drilling rig without needing to modify the drilling rig for system use.

In another aspect, the application provides a system for use with band brake drawworks including a pneumatic actuating means for controlling a drawworks brake lever without the necessity of a tension spring attached to the brake lever.

In another aspect, the application provides a system for controlling a brake lever of band brake drawworks without using a tension spring/wire line arrangement by employing a pneumatic actuating means for moving the brake lever to apply and release the band brake.

In another aspect, the application provides a system for improving automatic drilling efficiency by eliminating the time required to disengage and re-engage a tension spring/wire line arrangement when making a connection by employing instead a pneumatic actuating means for moving the brake lever, the pneumatic actuating means remaining attached to the brake lever during wellbore drilling operations.

In another aspect, the application provides for automatic wellbore drilling rig operations using band brake drawworks by employing a system including pneumatic operation of a drawworks brake lever. The system is operationally configured to provide constant drill string ROP and WOB down to a drill string weight of about 45 kg (about 100 pounds).

In another aspect, the application provides a system for controlling a brake lever of band brake drawworks on a wellbore drilling rig employing use of a downhole drilling motor.

In another aspect, the application provides a system for controlling a brake lever of band brake drawworks on a wellbore drilling rig, the system including an alarm means for signaling drillers/operators concerning one or more of parameters such as kelly stop limits, crown/floor safety stop limits, drill rotation speed limits, torque limits, mud pressure abnormality, and combinations thereof.

In another aspect, the present system provides an automatic stop function in relation to kelly stop omits, crown/floor safety stop limits, drill rotation speed limits, torque limits, mud pressure abnormality, and combinations thereof.

In another aspect, the application provides a system including a joystick for the remote control of a drawworks brake lever.

In another aspect, the application provides a system including control means operationally configured to provide anti-collision functioning of a travelling block between the derrick crown and drill-floor on a wellbore drilling rig.

In another aspect, the application provides a system for producing precise and continuous control of a drawworks band brake characterized by constant WOB and ROP drilling, optimized rotation of the drill-bit to improve drilling time savings, less wear on a drill-bit, and a better finishing wellbore.

Discussion of the System and Method

To better understand the novelty of the present system and method of use thereof, reference is hereafter made to the accompanying drawings. With reference to FIG. 1, the present invention comprises an integrated control system 10 operationally configured to provide automatic drilling, anti-collision functions and remote control of a hoisting system of a drilling rig. In particular, the control system 10 suitably includes (1) a pneumatic brake actuating means 12 for controlling the drawworks operation of a hoisting system, and (2) a control means (a) for measuring and interpreting one or more drilling parameters and (b) for controlling pressurized air flow to the pneumatic brake actuating means 12 in response to one or more measured drilling parameters.

The pneumatic brake actuating means 12 is operationally configured to control a winch type drawworks drum 14 used to wind and un-wind a drill-line 16 about a pulley system including a crown block 18 and traveling block 20. Although drawworks are available with different types of braking systems, the pneumatic brake actuating means 12 of this application is provided for implementation with drawworks band brakes 22 and accompanying brake levers 24. In application, the pneumatic brake actuating means 12 is effective for acting on the brake lever 24 to control the pay out and reeling in of the drill-line 16 about the drum 14.

The control means suitably includes an air regulation means and an electronic system. The electronic system suitably includes an electronic controller 28 and one or more sensors in communication with the electronic controller 28, the one or more sensors being effective to measure various drilling parameters in real lime, the data to be interpreted by the electronic controller 28. In addition, the control means may include display instrumentation effective to provide a driller/operator with the necessary data to manipulate the band brake 22 and/or the auxiliary brake to achieve desired drilling parameters. Suitably, the electronic controller 28 is operationally configured to send control outputs (1) to an auxiliary brake of the control system 10 (see arrow AA), (2) to the air regulation means to control the pneumatic brake actuating means 12 for releasing the band brake 22, and (3) to a crown/floor stop solenoid valve (see arrow BB) to control the kinetic energy level for slowing or stopping the traveling block 20 according to desired parameters.

Without limiting the invention, apposite drilling parameters may include, but are not necessarily limited to (a) WOB, (b) ROP, (c) kelly down stop safety functions, (d) RPM limits, (e) torque limits, (1) crown and floor collision prevention, (g) drilling fluid or mud pressure when employing a drilling motor or "mud motor" downhole, and combinations thereof. Likewise, a suitable electronic controller 28 may include a programmable logic controller ("PLC") operationally configured to carry out the control logics and output control signals to the electro-pneumatic regulator 30 for controlling the pneumatic brake actuating means 12.

Still referring to FIG. 1, the control means suitably includes a first weight sensor 32 optimally positioned at a deadline anchor 33 and operationally configured to measure the total hoisting weight on the traveling block 20 as transferred to a deadline 35. The control means may also include a second ROP/Block speed sensor 34. Located at the drum 14, the ROP/Block speed sensor 34 is operationally configured to measure the rate of revolution and direction of the drum 14. The rate of revolution is received by the electronic controller 28 for calculating the position of the traveling block 20 and the speed of drilling. The control means may also include a third block position sensor 36 operationally configured as a reference sensor for providing a reference point of the traveling block 20 in relation to the drill floor. The block position sensor 36 suitably operates to correct any measurement errors encountered by the ROP/Block speed sensor 34. A fourth kelly down/lower limit sensor 38 may also be provided on the drilling derrick as a lower limit sensor of the kelly and corresponding traveling block 20. In operation, the kelly down sensor 38 suitably provides a stop signal to the electronic controller 28 for disabling drilling operations when the kelly travels within a preset distance to the rotary table 39.

A fifth RPM sensor 40 may be employed near the rotary table 39 that is operationally configured (1) to detect speed changes in the rotation speed of the drill pipe 26, and (2) to trigger an alarm 43 once a preset upper or lower limit for the rotation speed is reached. Likewise, a sixth torque sensor 42 in communication with the drive system of the rotary table 39 may be employed (1) to detect the torque placed on the drill pipe 26 and any unusual conditions imposed on the drill pipe 26, and (2) to trigger the alarm 43 as a preset torque upper limit is reached. In drilling operations that include a downhole drilling motor, the system 10 may include a seventh drilling fluid pressure sensor 44, i.e., "mud pressure sensor," operationally configured to detect pressure changes in drilling fluid pressure in the drill pipe cavity leading to the drilling motor turning the drill bit 46, i.e., delta pressure, as understood by persons of ordinary skill in the drilling industry.

The control means may also include a driller's display panel 48 in communication with the electronic controller 28. The display panel 48 acts as a human interface between the driller/operator and the system 10 for maintaining desired drilling parameters, e.g., constant WOB, constant ROP, delta pressure, as well as assisting a driller/operator in operating a drawworks assembly with accuracy and precision to achieve one or more desired drilling parameters.

During drilling operations, information is suitably relayed from the one or more sensors to the electronic controller 28, the control logics embodied in the electronic controller 28 being operationally configured to carry out various functions effective for signaling and controlling (1) the pneumatic brake actuating means 12 via the electro-pneumatic regulator 30 (2) the audible alarm 43, (3) the auxiliary brake of the drum 14, and (4) the crown/floor stop solenoid.

Figure 2:
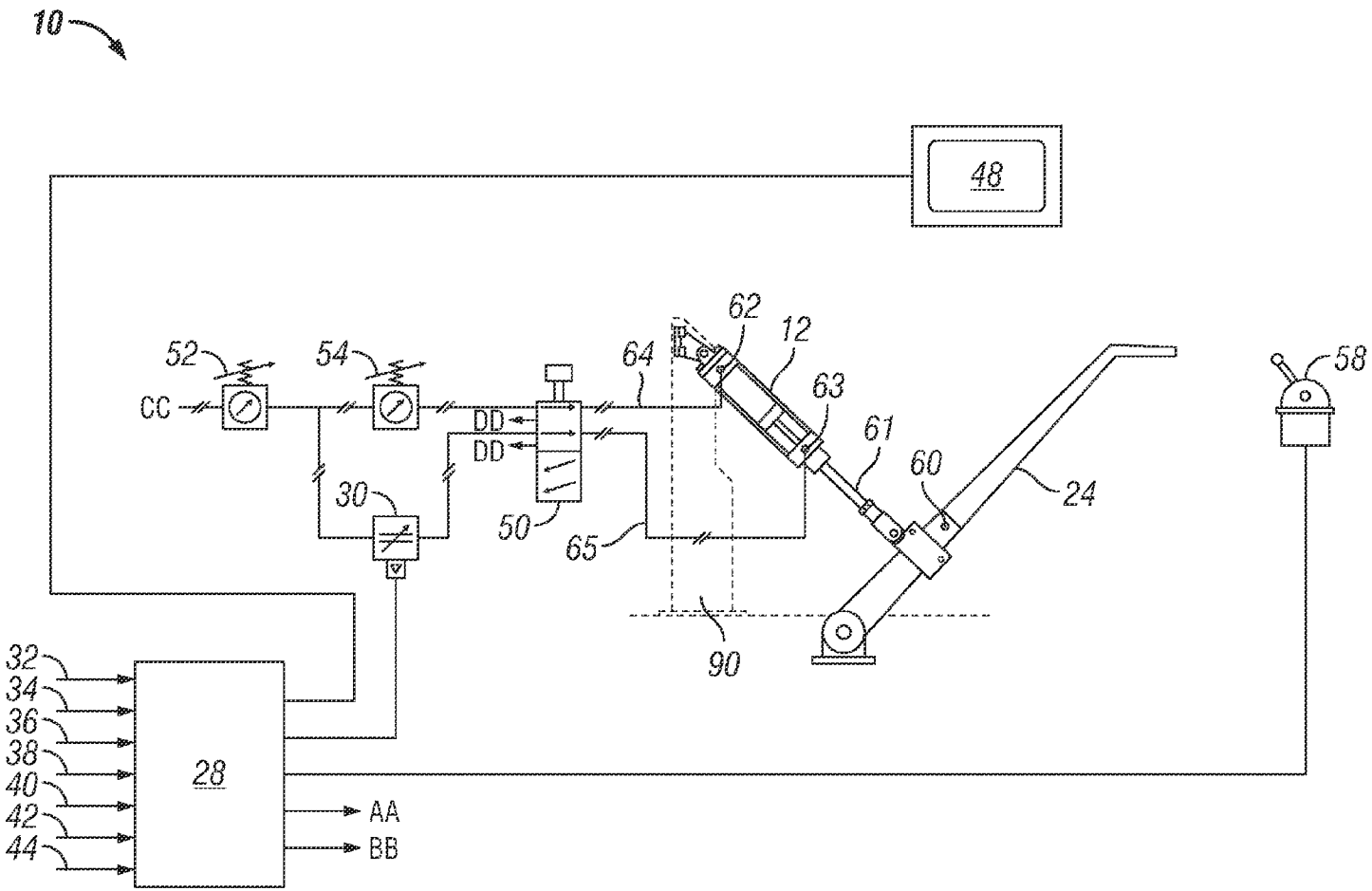
FIG. 2 illustrates another simplified embodiment of the present system.

As illustrated in FIG. 2, the control means suitably includes an air regulation means (1) in electrical communication with the electronic controller 28 and (2) in fluid communication with both a pressurized air source (see CC) and the pneumatic brake actuating means 12. In a particularly advantageous embodiment, the pneumatic brake actuating means 12 includes a double acting pneumatic cylinder (hereafter "cylinder") in fluid communication with the air regulation means. As understood by persons of ordinary skill in the art, double acting pneumatic cylinders use the force of air to move the piston rod 61 of the cylinder 12 in both extend and retract strokes. In this embodiment, the cylinder 12 has two ports 62, 63 to allow pressurized air to flow in and out of the cylinder 12. Outstroke of the piston rod 61 of the cylinder 12 is achieved when pressurized air enters the cylinder 12 through the brake apply port 62. Instroke of the piston rod 61 of the cylinder 12 is achieved when pressurized air enters the cylinder 12 through the brake release port 63.

Although the air regulation means may receive pressurized air from one or more sources, in a particularly advantageous embodiment, the air regulation means is operationally configured to receive pressurized air readily available in drilling rig operations (hereafter referred to as "rig air"), e.g., a drilling rig air compressor for supplying air to the clutch. The use of rig air eliminates the need to provide a separate air compressor for operating the cylinder 12.

As FIG. 2 illustrates, rig air is suitably received by a first air regulator 52 of the air regulation means operationally configured to regulate the pressure of the incoming rig air to the air pressure of the system 10. Although the system 10 may be built to scale, the air pressure of the system 10 is suitably about 4.1 bar (about 60 psi). Typical rig air pressure ranges from about 3.5 bar to about 5.5 bar (about 50 psi to about 80 psi).

Once the rig air pressure has been normalized to system 10 requirements, the air flows from the first air regulator 52 to both a second air regulator 54 and the electro-pneumatic regulator 30. The second air regulator 54 is operationally configured to set the air pressure necessary to provide a force on the apply side of the piston rod 61 of the cylinder 12, and the electro-pneumatic regulator 30 is operationally configured to regulate the air pressure to the brake release side of the piston rod 61 of the cylinder 12 according to control outputs transmitted by the electronic controller 28—discussed in more detail below.

The pressurized air suitably flows from both the second air regulator 54 and electro-pneumatic regulator 30 to an on/off valve 50 that is operationally configured to engage and disengage the automatic function or operation of the cylinder 12. For example, when the on/off valve 50 is set to "ON," pressurized air received by the on/off valve 50 from the second air regulator 54 is directed to the brake apply port 62 via conduit 64 at a constant pressure effective to maintain the piston rod 61 of the cylinder 12 in an outstroke position to bias the brake lever 24 to apply the band brake 22 in a continuous manner. In suitable system 10 operation, the brake lever 22 remains biased applying the band brake 22 until a pressure differential within the cylinder 12 forces the piston rod 61 to an instroke position as dictated by pressurized air flowing to the brake release port 63 from the electro-pneumatic regulator 30 via conduit 65. In other words, the electro-pneumatic regulator 30 is operationally configured to regulate the amount of pressurized air flowing to the brake release port 63. Although pressure requirements may change, suitable conduits 64, 65 may include, but are not necessarily limited to air compressor type hoses constructed from rubber, polyvinyl chloride, polyurethane, and combinations thereof. Air hose couplers or connectors may also be employed as desired.

In detail, when release of the drawworks band brake 22 is required, the electronic controller 28 signals the electro-pneumatic regulator 30 to provide pressurized air flow to the brake release port 63 of the cylinder 12 wherein the pressure differential within the cylinder 12 drives the piston rod 61 to an instroke position drawing the brake lever 24 toward the cylinder 12. Once one or more desired drilling parameters are met, the electronic controller 28 suitably signals the electro-pneumatic regulator 30 to reduce or shut off air flow to the brake release port 63 of the cylinder 12, whereby the constant air pressure from the second air regulator 54 forces the piston rod 61 of the cylinder 12 to an outstroke position driving the brake lever 23 back to a brake position of the band brake 22 as shown in FIG. 2.

Although not necessarily limited to a particular embodiment, a suitable on/off valve includes a six port/two way valve for automatic control of the cylinder 12. When the on/off valve 50 is set to "OFF" air pressure to the cylinder 12 is disabled. In particular, when the on/off valve 50 is set to "OFF" pressurized air in the cylinder 12 flows out to the ambient environment through vent ports located on the on/off valve 50 (see arrows DD). Once the cylinder 12 is vented on both sides of the piston rod 61, the cylinder 12 achieves atmospheric pressure allowing the cylinder 12 to move freely in either direction, i.e., outstroke and instroke. Thus, when the on/off valve 50 is set to "OFF," the drilling rig is no longer operating on automatic according to the system 10. Rather, in "OFF" position the brake lever 24 may be operated manually to control the band brake 22.

Manual operation of the brake lever 24 may be desirable during particular drilling activities such as when making a connection. In such instance, once a drill pipe joint is added to the drill string the on/off valve 50 may be reset to "ON" re-pressuring the cylinder 12 to an outstroke position of the piston rod 61 to reapply the band brake 22. Since the cylinder 12 may remain attached to the brake lever 24 at all times during drilling operations, no time is spent removing and reattaching the cylinder 12. Instead, a driller/operator may simply control the on/off valve 50.

Figure 4:
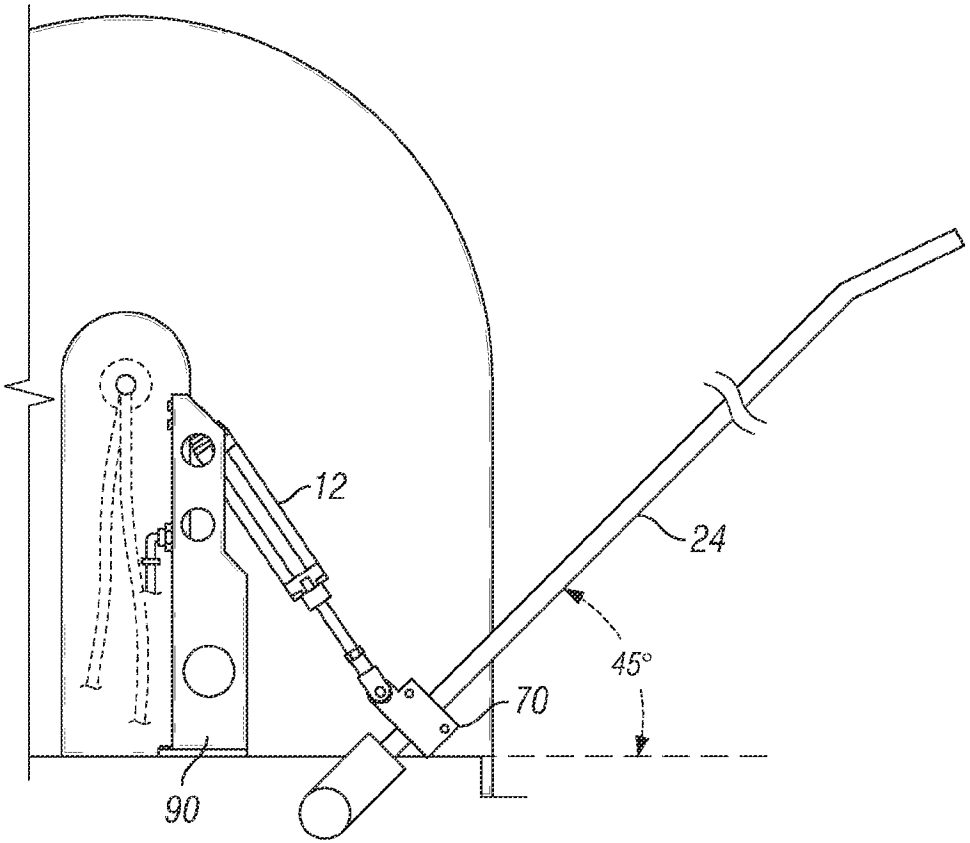
FIG. 4 illustrates the pneumatic brake actuating means of FIG. 3 wherein the piston rod of the actuating means is in an outstroke position and the brake lever is at an non-vertical position applying the band brake.
Figure 3:
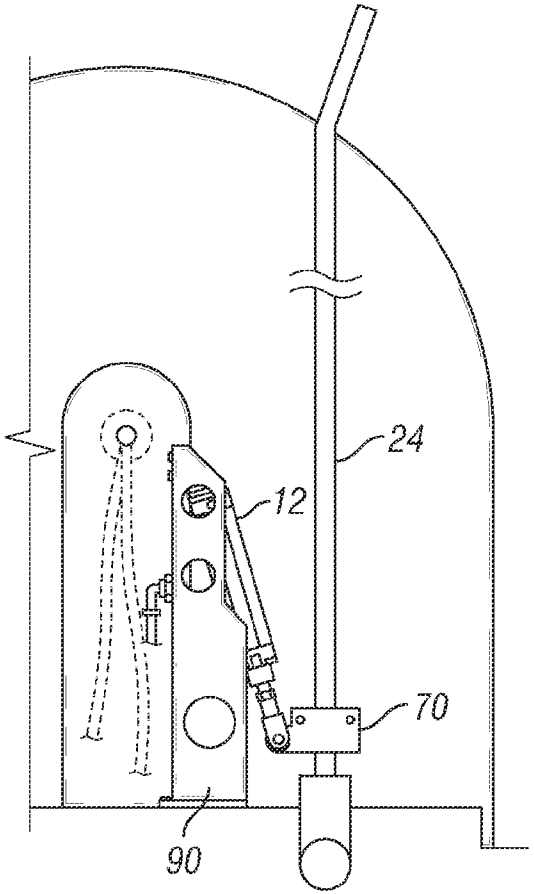
FIG. 3 illustrates a simplified embodiment of the pneumatic brake actuating means of the system including the actuating means being attached to a brake lever of band brake drawworks. The piston rod of the actuating means is in an instroke position with the brake lever in an upright position releasing the band brake.

Turning to FIGS. 3 and 4, a typical drawworks brake lever 24 is operationally configured to pivot from a first position about vertical to a support surface (see FIG. 3) to a second position closer to the support surface forming an angle there between (represented as 45 degrees in FIG. 4). The first position of the brake lever 24 in FIG. 3 represents a brake release position of the brake lever 24 and the second position of the brake lever 24 in FIG. 4 represents a brake apply position of the brake lever 24.

In one embodiment, the cylinder 12 may be attached to the support surface at one end and attached to the brake lever 24 at an opposing end. In a particularly advantageous embodiment, a first end of the cylinder 12 is attached to a support surface such as a support frame 90 and the second end of the cylinder 12 is attached to the brake lever 24 in a manner effective for the brake lever 24 to pivot about the support surface through a full range of motion unhindered by the cylinder 12 as depicted in FIGS. 3 and 4.

Figure 5A:
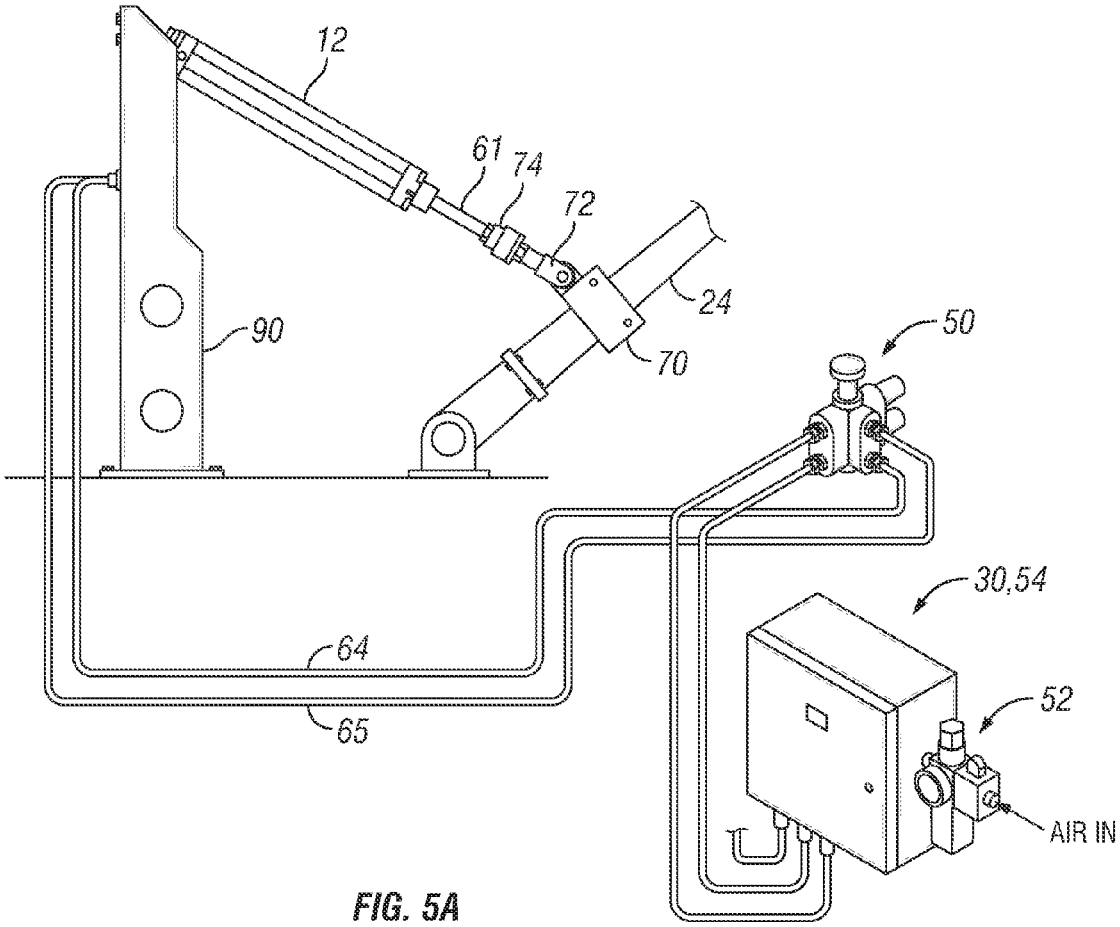
FIG. 5A illustrates a simplified embodiment of regulation means and pneumatic brake actuating means of the system.
Figure 5B:
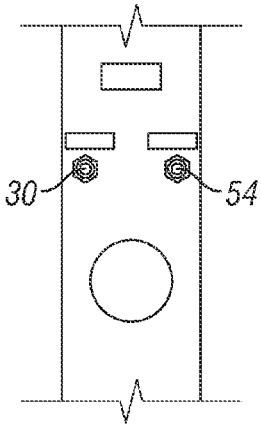
FIG. 5B illustrates a partial view of the support frame of FIG. 5A including connection ports for pressurized air flow to and from the pneumatic brake actuating means.
Figure 6:
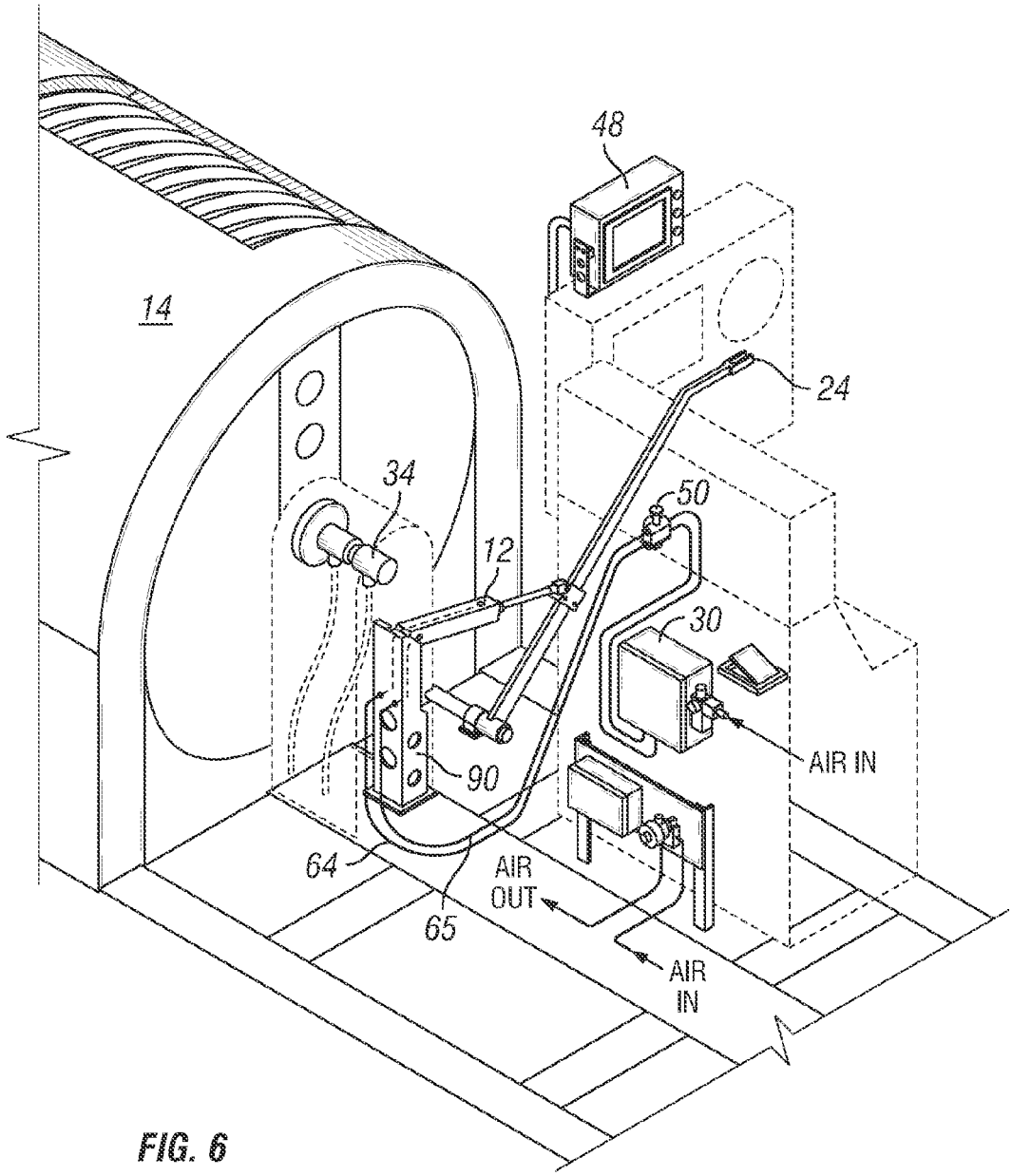
FIG. 6 illustrates a perspective view of the air regulation means and pneumatic brake actuating means of the system installed on a band brakes drawworks.

With reference to FIG. 5A, the first end of the cylinder 12 is pivotally attached to the support frame 90 and the second end of the cylinder 12 is pivotally attached to the brake lever 24. Without limiting the means of attachment, the second end of the cylinder 12 suitably includes a collar assembly 70 operationally configured to sandwich or surround the brake lever 24 in a manner effective to slide along the length of the brake lever 24. To further promote pivoting action of the cylinder 12, the cylinder 12 is suitably releasably attached to the collar assembly 70 via a pivot pin type quick connection 72 attached to the piston rod 61 either directly or via an optional flexible joint 74. As depicted in FIG. 5B, pressurized air may flow to and from the cylinder 12 at the support frame 90 via ports 66, 67 operationally configured to fluidly receive conduits 64 and 65.

Turning again to FIG. 2, some brake levers 24 come equipped with quick connect/disconnect mechanisms 60 allowing the distal section of the brake lever 24 to be removed as desired. As shown, the cylinder 12 is suitably connected to a permanent section of the brake lever 24 to control the permanent section of the brake lever 24 in instances where the distal section of the brake lever 24 is removed.

Figure 7:
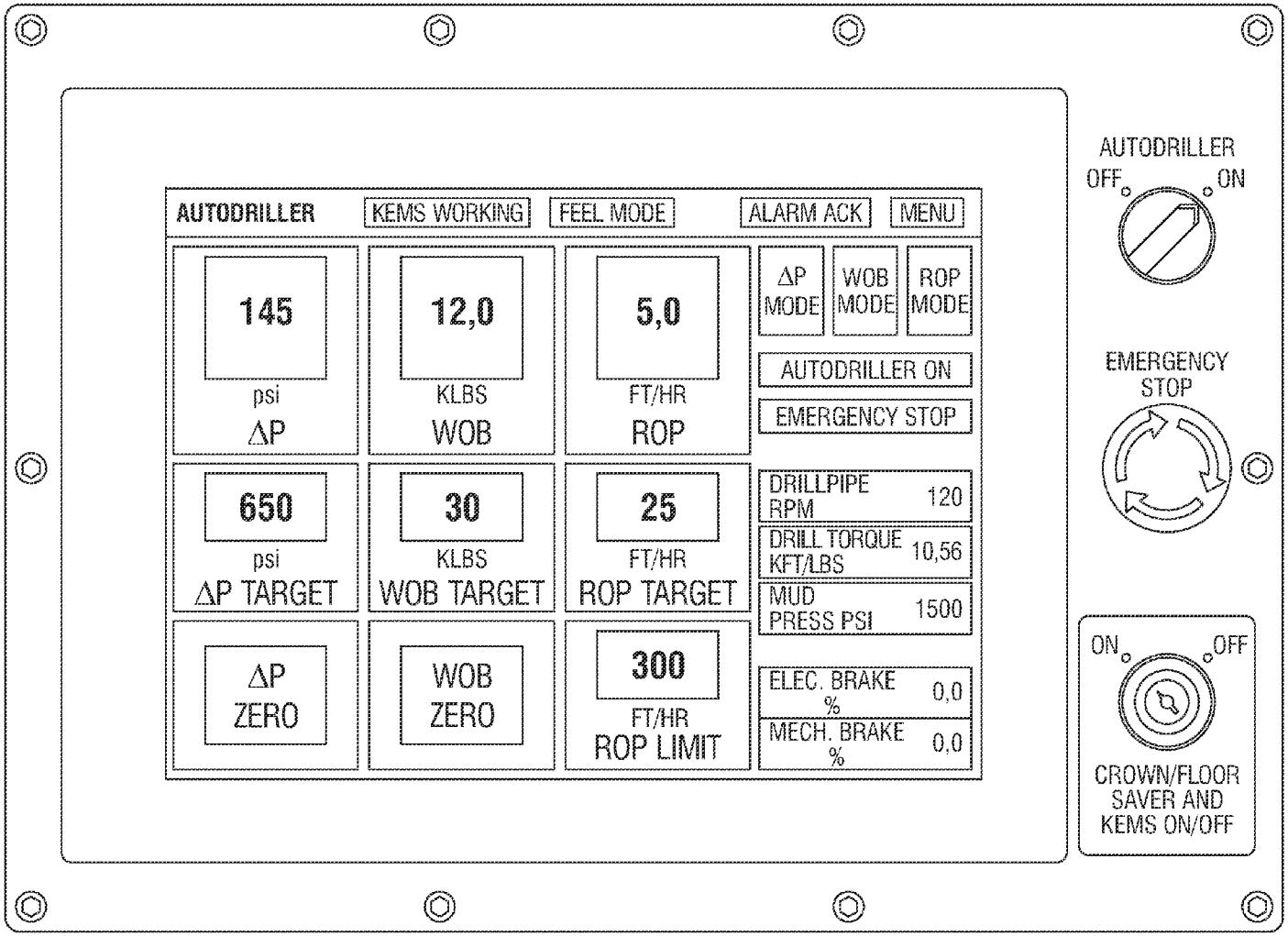
FIG. 7 illustrates a simplified view of the display panel of the system displaying automatic drilling parameters.
Figure 8:
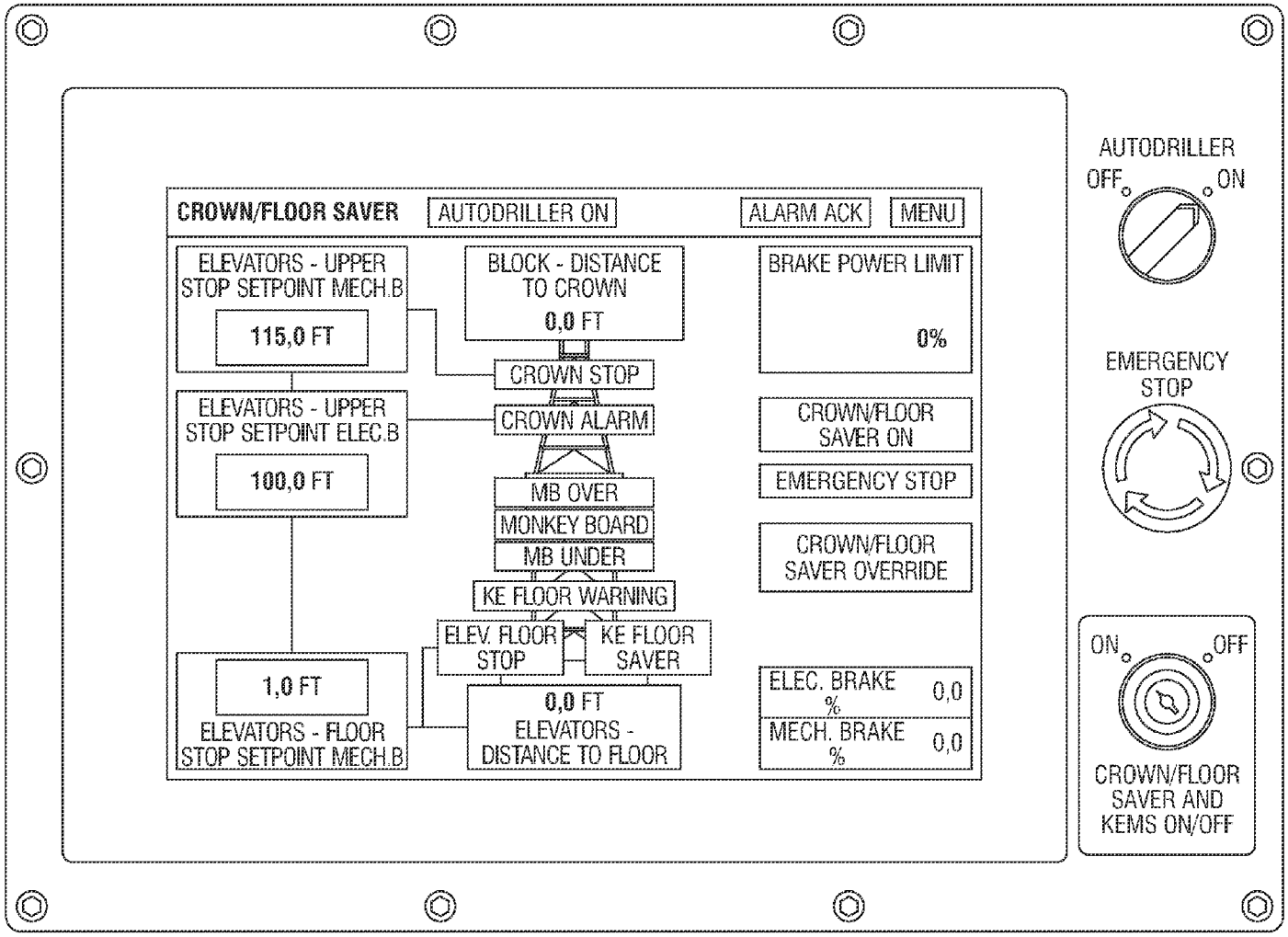
FIG. 8 illustrates a simplified view of the display panel of the system displaying the crown and floor saver parameters.
Figure 9:
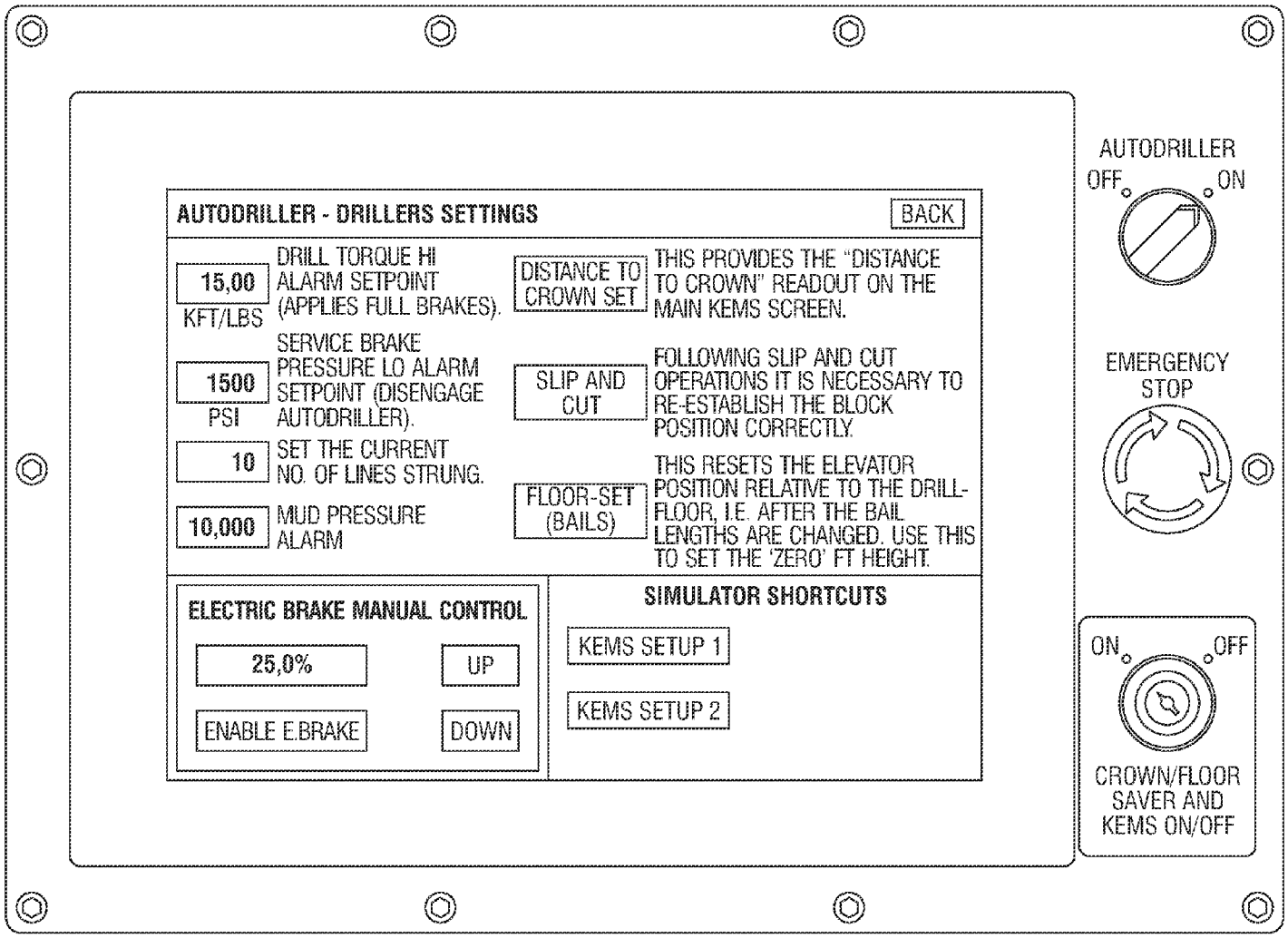
FIG. 9 illustrates a simplified view of the display panel of the system displaying the driller/operator's setting parameters.

The present system 10 may also employ remote manual operation of the cylinder 12 via a servo joystick 58 as desired. Although not necessarily limited to a particular mode of operation, the servo joystick 58 suitably includes a typical hand controlled joystick lever wherein movement of the joystick lever is converted to an electrical signal for operating the cylinder 12 to apply and release the drawworks band brake 22. Automatic and manual control modes of the drawworks servo brake may be selected via the driller's display panel 48 (see FIG. 7, FIG. 8 and FIG. 9). In manual mode, a signal from the band brake drawworks servo joystick 58 is relayed to the electronic controller 28 whereby a joystick signal is then sent to the electro-pneumatic regulator 30 for a quick respond servo action of the drawworks band brake 22. Similar as automatic operation of the system 10, manual operation of the system 10 using the servo joystick 58 may be performed with the distal section of the brake lever 24 either attached to or removed from the permanent section of the brake lever 24.

As FIG. 1 illustrates and as understood by persons of ordinary skill in the art, the traveling block 20 together with rotating equipment such as a kelly 56 and/or rotary table 39 are operationally configured to hoist the drill pipe 26 and drill bit 46 attached thereto. In operation, the brake lever 24 may be manipulated to release the band brake 22 allowing the drum 14 to rotate in a manner effective to pay out drill-line 16 to lower the traveling block 20 thereby increasing the WOB on the drill bit 46 against the earth formation 5.

As stated above, the present system 10 may also include a crown/floor stop solenoid operationally configured to monitor kinetic energy of the drill string to prevent collision of the traveling block 20 with the crown block 18 and drill floor. Suitably, the electronic controller 28 is operationally configured to relay desired stop position information to the cylinder 12 and auxiliary brake to control the travel distance of the traveling block 20 as to an upper and lower limit.

During drilling operations collected information is relayed to the electronic controller 28 from the weight sensor 32, ROP; Block speed sensor 34, and block position sensor 36 to calculate (1) the actual position of the traveling block 20 with reference to upper and lower limits of travel distance, and (2) the kinetic energy level at any one time. Suitably, the kinetic energy of the traveling block 20 is monitored and controlled in a manner effective to maintain the kinetic energy of the traveling block 20 within a predetermined upper limit by activating the auxiliary brake on the drawworks as required. In the event of auxiliary brake failure or if the auxiliary brake has failed to bring the kinetic energy of the traveling block 20 to within the preset upper limit, the electronic controller 28 is operationally configured to activate the band brake 22 to halt the traveling block 20.

The invention will be better understood with reference to the following non-limiting example, which is illustrative only and not intended to limit the present invention to a particular embodiment.

EXAMPLE 1

In a first non-limiting example, the present system 10 is installed on pre-existing drilling rig including band brake drawworks.

Prior to installation of the system 10, the drilling rig operated automatically using (1) a tension spring to bias the drawworks brake lever downward along a vertical plane (to apply the band brake) and (2) a wire line attached to the brake lever to raise the brake lever along a vertical plane (to release the band brake). The tension spring/wire line arrangement requires approximately one minute of time to disengage and then re-engage the tension spring and wire line to the brake lever when making a connection. In particular, when drilling to a depth of about 3048 meters (about 10,000 feet) using 111 stands (333 single joints of drill-pipe) at about 27.4 meters (about 90 feet) per stand, the total elapsed time required to disengage and then re-engage the tension spring and wire line when making connections is approximately 111 minutes, i.e., 1.85 hours.

Once the system 10 is installed, drilling to the same depth of about 3048 meters (about 10,000 feet) takes about 1.85 hours less time than the same drilling rig using the tension spring/wire line arrangement.

Persons of ordinary skill in the art will recognize that many modifications may be made to the present application without departing from the spirit and scope of the application. The embodiment(s) described herein are meant to be illustrative only and should not be taken as limiting the invention, which is defined in the claims.

I claim:

1. A system providing automatic and manual control of a brake lever on band brake drawworks of a wellbore drilling rig, comprising:

a pneumatic cylinder attached to the brake lever; and a control means in fluid communication with the pneumatic cylinder, the control means being operationally configured to run the pneumatic cylinder in response to information obtained by the control means concerning one or more drilling parameters and operationally configured to disable the pneumatic cylinder.

2. The system of claim 1 wherein the pneumatic cylinder is a pneumatic double acting cylinder.

3. The system of claim 2 wherein the control means is operationally configured to regulate pressurized air flow from an air source to the double acting cylinder.

4. The system of claim 3 wherein said pressurized air flow is effective to maintain a constant pressure differential of the double acting cylinder in a first outstroke position of the double acting cylinder.

5. The system of claim 4 wherein the control means is operationally configured to regulate pressurized air flow to the double acting cylinder to maintain a constant pressure differential of the double acting cylinder in a second opposing instroke position.

6. The system of claim 1 wherein said drilling parameters are selected from the group consisting of weight-on-bit, rate of penetration, kelly down stop safety functions, RPM limits, torque limits, crown and floor collision prevention, and drilling fluid pressure.

7. The system of claim 1 wherein the pneumatic cylinder is pivotally attached to a support surface at a first end and pivotally attached to the brake lever at a second end.

8. A system for controlling band brake drawworks on a wellbore drilling rig, comprising:

a pneumatic double acting cylinder attached to a brake lever of the band brake drawworks;

an air regulation means in fluid communication with an air supply and the pneumatic double acting cylinder; and an electronic control means in communication with the air regulation means, the electronic control means being operationally configured to (1) measure drilling information concerning one or more drilling parameters and (2) send control outputs to the air regulation means to dictate pressurized air flow to and from the pneumatic double acting cylinder.

9. A method for automatically controlling a brake lever on band brake drawworks of a wellbore drilling rig to provide constant weight-on-bit and rate of penetration drilling, comprising:

installing to a wellbore drilling rig (1) a pneumatic cylinder pivotally attached to a support surface at a first end and pivotally attached to the brake lever at a second end; and (2) a control means in fluid communication with the pneumatic cylinder, the control means being operationally configured to direct the flow of pressurized air to and from the pneumatic cylinder according to measured drilling information concerning one or more drilling parameters as measured by the control means;

operating the control means to position the pneumatic cylinder and brake lever in a brake position to apply the band brake prior to drilling;

measuring one or more drilling parameters via the control means during drilling;

adjusting the pneumatic cylinder and brake lever from the brake position to a brake release position according to one or more measured drilling parameters; and adjusting the pneumatic cylinder and brake lever from the brake release position to the brake position once desired drilling parameters are achieved.

10. The method of claim 9 herein the one or more drilling parameters are selected from the group consisting of eight-on-bit, rate of penetration, kelly down stop safety functions, RPM limits, torque limits, crown and floor collision prevention, and drilling fluid pressure.

* * * * *